US009977376B1

(12) United States Patent
Cook

(10) Patent No.: US 9,977,376 B1
(45) Date of Patent: May 22, 2018

(54) METHOD TO CONTROL TRANSFER OF BLACK AND COLOR TONED IMAGES DURING SIMPLEX PRINTING

(71) Applicant: Lexmark International, Inc., Lexington, KY (US)

(72) Inventor: William Paul Cook, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days. days.

(21) Appl. No.: 15/395,627

(22) Filed: Dec. 30, 2016

(51) Int. Cl.
*G03G 15/00* (2006.01)
*G03G 15/16* (2006.01)
*G03G 15/01* (2006.01)

(52) U.S. Cl.
CPC ..... *G03G 15/1615* (2013.01); *G03G 15/0131* (2013.01)

(58) Field of Classification Search
CPC ... G03G 2215/0119; G03G 2215/0158; G03G 15/0194; G03G 15/0121; G03G 15/0131; G03G 15/50; G03G 15/1615; G03G 2221/1657
See application file for complete search history.

(56) References Cited

U.S. PATENT DOCUMENTS

2014/0153945 A1* 6/2014 Yoshioka ..... G03G 15/1615 399/66

* cited by examiner

*Primary Examiner* — Walter L Lindsay, Jr.
*Assistant Examiner* — Jessica L Eley

(57) ABSTRACT

A method for controlling transfer of black color toned images during simplex printing. The method comprises identifying a first image of a print job is a black-only image, determining whether or not the print job includes at least one color image, upon determining that the print job includes at least one color image, rotating only the black photoconductive (PC) drum and transferring a black-only toned first image thereon onto a rotating intermediate transfer member (ITM) belt and subsequently onto a surface of the media sheet at the image transfer roll, and moving color transfer rolls into engagement the color PC drums and pausing their rotation, and, upon determining that the print job does not include at least one color image, moving the color transfer rolls to disengage the ITM belt from the color PC drums and rotating only the black PC drum to sequentially transfer each remaining black-only toned image onto the ITM belt for printing on a surface of a corresponding next sequential media sheet at the image transfer roll.

11 Claims, 10 Drawing Sheets

METHOD TO CONTROL TRANSFER OF BLACK AND COLOR TONED IMAGES DURING SIMPLEX PRINTING

CROSS REFERENCES TO RELATED APPLICATIONS

None.

STATEMENT REGARDING FEDERALLY SPONSORED RESEARCH OR DEVELOPMENT

None.

REFERENCE TO SEQUENTIAL LISTING, ETC.

None.

BACKGROUND

1. Field of the Disclosure

The present disclosure relates generally to electrophotographic imaging devices such as a printer or multifunction device having printing capability, and in particular to methods for controlling the transfer of toned black and color images during simplex printing.

2. Description of the Related Art

Color imaging devices contain two or more cartridges, each of which transfers a different color of toner to a media sheet as required to produce a full color copy of a toner image. A common imaging device includes four separate color cartridges—cyan, yellow, magenta, and black. Image formation for each of the four colors includes moving toner from a reservoir to an imaging unit where toned images, black or color are formed on photoconductive (PC) drums prior to transfer directly to a media sheet or to an intermediate transfer member (ITM) belt for subsequent transfer to a media sheet.

When printing black-only images, the color imaging units and, in particular, their PC drums, may run even when no color images are printed. This leads to additional wear on these PC drum and the toner particles. As such, two methods have been developed to reduce or eliminate such wearing by stopping the color imaging units while printing black-only images. In both methods, at least one motor is coupled to the color imaging units and another motor is coupled to the black imaging unit so that the black imaging unit can be run independently of the color imaging units. In the first method, the color motor is stopped and the ITM belt is allowed to slip between each nip formed between the color PC drums and a plurality of transfer rolls. The method only requires small gaps for each transition between black only and color printing. However, the charge on the surfaces of the color PC drums changes due to the movement of the ITM belt, requiring the color PC drums to be rotated occasionally while printing black pages such that the color PC drums will be fully recharged and cleaned at the end of every print job even if no color pages were printed. Rotation of the color PC drum also causes the color toners to be agitated as the color PC drum and toner agitators are coupled together and driven by the same motor. While this reduces color supply consumption, the color supplies may still need to be replaced due to wear on the PC drums even when no color pages were ever printed and where the color toner particles carry extra particulate additives (EPAs) the additional agitation may knock some of these EPAs from their carrier toner particles affecting toner performance.

In the second method, each transfer roll forming a nip with the color PC drums is retracted allowing the ITM belt to separate from the PC drums when printing black-only images and the color motor is stopped causing the color PC drums to stop rotating as well. When transitioning to printing color images, each retracted transfer roll is moved towards the color imaging units, moving the ITM belt to engage with the color PC drums and the color motors are restarted to rotate each of the color PC drums. This sequence reduces throughput when a print job contains both color and black-only images.

It would be advantageous to have a method of controlling the transfer of toned images that avoid the drawbacks of these two prior art methods.

SUMMARY

Disclosed is a method of controlling printing a print job having two or more consecutive images using an imaging device. The imaging device has a media transport path extending from an input media source to a media output area for transporting a media sheet to be printed, a rotating intermediate transfer member (ITM) belt forming an endless loop having an inner surface and an outer surface, a portion of the outer surface having a toned transferred image thereon positioned adjacent to an image transfer roll positioned along a media transport path for transferring the toned transferred image onto a surface of the media sheet to be printed, a plurality of color imaging units each having a color photoconductive (PC) drum and an associated color charging roll in contact therewith, each color PC drum engageable with the ITM belt for depositing a color toned image when present to the outer surface of the ITM belt, a black imaging unit having a black PC drum and an associated black charging roll in contact therewith, the black PC drum engaged with the ITM belt for depositing a black toned image when present to the outer surface of the ITM belt, a black transfer roll being in an engaged position against the inner surface of the ITM belt and positioned to press the outer surface of the ITM belt against the outer surface of the black PC drum, a plurality of retractable color transfer rolls being disposed adjacent to the inner surface of the ITM belt, the plurality of color transfer rollers moveable between an engaged position and a disengaged position wherein when in the engaged position respective ones of the plurality of color transfer rolls press the outer surface of the ITM belt into contact with the outer surface of a respective one of the plurality of color PC drums and, when in the disengaged position, the outer surface of the ITM belt is separated from the outer surface of the respective color PC drum of the at least one color imaging unit, and a controller communicatively coupled to the plurality of color imaging units, the black imaging unit, the black transfer roll and the plurality of retractable color transfer rolls and configured to control the operation thereof and to perform the method.

The method comprises identifying that a first image of a print job is a black-only image, determining whether or not the print job includes at least one color image and upon determining that the print job includes at least one color image:

rotating only the black photoconductive drum and transferring a black-only toned first image thereon onto the outer surface of the rotating ITM belt and subsequently onto a surface of the media sheet at the image transfer roll; and moving each respective color transfer roll into its respective engaged position with its respective color PC drum and pausing the rotation of the color PC drums.

Upon determining that the print job does not include at least one color image:

moving each respective color transfer roll into its respective disengaged position; and, rotating only the black photoconductive drum to sequentially transfer each remaining black-only toned image thereon onto the outer surface of the rotating ITM belt and subsequently onto a surface of a corresponding next sequential media sheet at the image transfer roll.

BRIEF DESCRIPTION OF THE DRAWINGS

The above-mentioned and other features and advantages of the disclosed embodiments, and the manner of attaining them, will become more apparent and will be better understood by reference to the following description of the disclosed embodiments in conjunction with the accompanying drawings.

DETAILED DESCRIPTION

Figure 1:
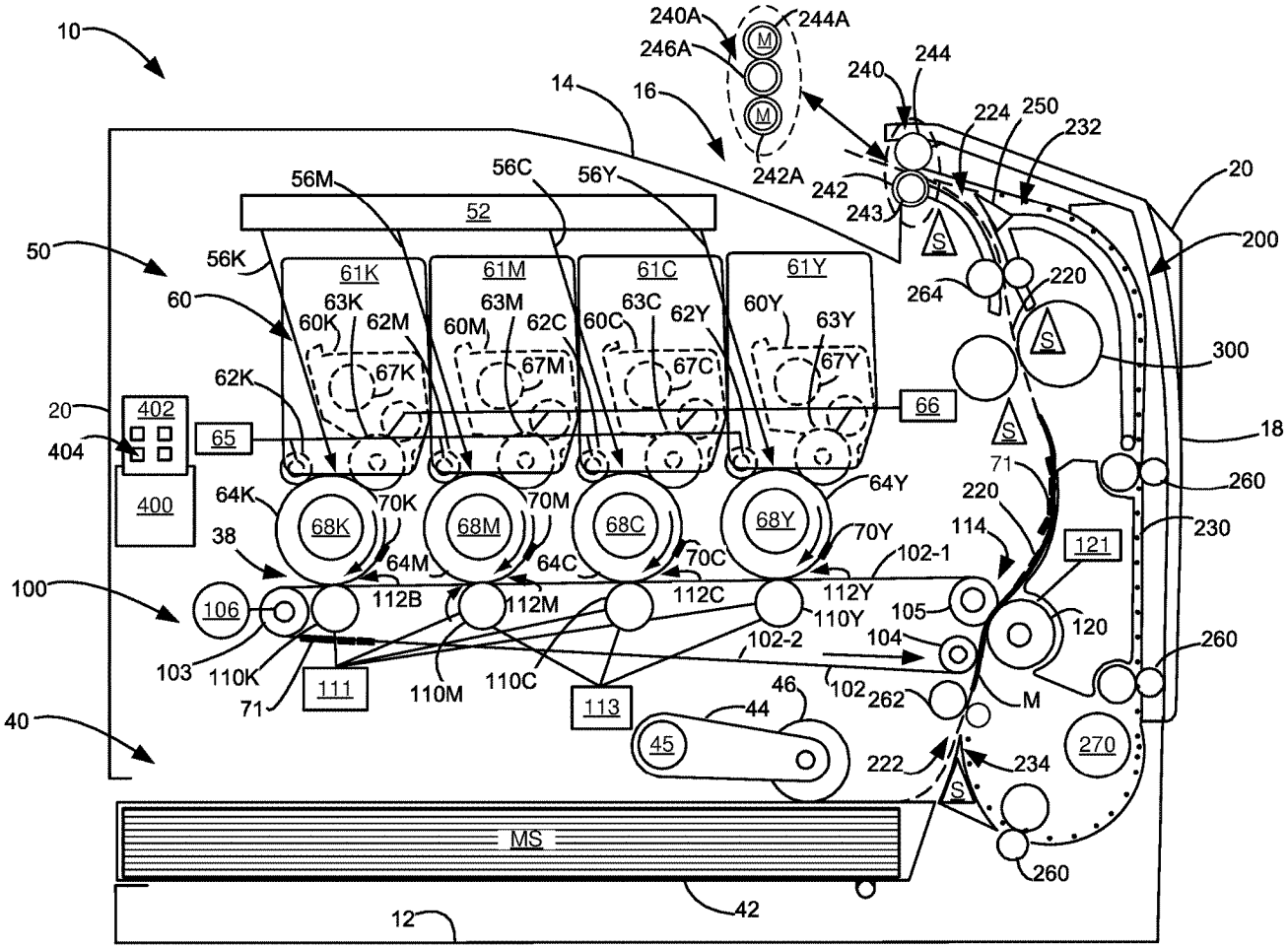
FIG. 1 is a schematic view of an electrophotographic imaging device according to an example embodiment of the present disclosure.

It is to be understood that the present disclosure is not limited in its application to the details of construction and the arrangement of components set forth in the following description or illustrated in the drawings. The present disclosure is capable of other embodiments and of being practiced or of being carried out in various ways. Also, it is to be understood that the phraseology and terminology used herein is for the purpose of description and should not be regarded as limiting. As used herein, the terms "having", "containing", "including", "comprising", and the like are open ended terms that indicate the presence of stated elements or features, but do not preclude additional elements or features. The articles "a", "an" and "the" are intended to include the plural as well as the singular, unless the context clearly indicates otherwise. The use of "including," "comprising," or "having" and variations thereof herein is meant to encompass the items listed thereafter and equivalents thereof as well as additional items.

Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings. Spatially relative terms such as "top", "bottom", "front", "back", "rear" and "side" "under", "below", "lower", "over", "upper", and the like, are used for ease of description to explain the positioning of one element relative to a second element as viewed in the accompanying figures. These terms are intended to encompass different orientations of the device in addition to different orientations than those depicted in the figures. Further, terms such as "first", "second", and the like, are also used to describe various elements, regions, sections, etc. and are also not intended to be limiting. Like terms refer to like elements throughout the description.

Terms such as "about" and the like have a contextual meaning, are used to describe various characteristics of an object, and have their ordinary and customary meaning to persons of ordinary skill in the pertinent art. Terms such as "about" and the like, in a first context mean "approximately" to an extent as understood by persons of ordinary skill in the pertinent art; and, in a second context, are used to describe various characteristics of an object, and in such second context mean "within a small percentage of" as understood by persons of ordinary skill in the pertinent art.

In addition, it should be understood that embodiments of the present disclosure include both hardware and electronic components or modules that, for purposes of discussion, may be illustrated and described as if the majority of the components were implemented solely in hardware. However, one of ordinary skill in the art, and based on a reading of this detailed description, would recognize that, in at least one embodiment, the electronic based aspects of the invention may be implemented in software. As such, it should be noted that a plurality of hardware and software-based devices, as well as a plurality of different structural components may be utilized to implement the invention. Furthermore, and as described in subsequent paragraphs, the specific mechanical configurations illustrated in the drawings are intended to exemplify embodiments of the present disclosure and that other alternative mechanical configurations are possible.

The term "media" as used herein encompasses any material for receiving an image. Unless otherwise stated, media is generally rectangular having a top surface or top side and a bottom surface or bottom side. The "leading edge" of a media is the first portion to enter a media feed path. The "trailing edge" of media is the last portion of a media to enter a media feed path. The "side edges" of a media or the "left edge" and "right edge" of a media refer to the edges of the media that are parallel to the media feed path as viewed in the media feed direction. A "margin" is an area of a surface or side of the media beginning at an edge and extending inwardly to a predetermined height or width. A "top margin" extends from the leading edge to a given height. A "bottom margin" extends from the trailing edge to a given height. A side margin extends from a side edge to a given width. Typically as viewed from a media feed direction, a right margin extends from the right edge to a given width and a left margin extends from the left edge. The area of the media bounded by the margins may be termed the "image area" containing text or images to be scanned or to be printed, depending on context.

The term "media transport path" is the route along which media travels in an image forming device and refers to the path from a media input area to a media output area of the image forming device or any portion thereof. The media transport path may have a "simplex portion or path" used when only one side of a media sheet is to be printed and a "duplex portion" that returns a simplex printed media sheet back to the simplex path and through the imaging area to receive a second image on the reverse side thereof. The entrance and exit of the duplex portion are in communication with the exit and entrance of the simplex portion. The term "media feed direction" or "MFD" indicates the direction that media travels within the image forming device or a subassembly thereof.

Unless otherwise indicated "a media feed roll pair" consists of a driven roll and an idler roll that are axially aligned and which form a nip or feed nip therebetween through which media is moved along the media transport path. The driven roll is operably coupled to a drive source in the image forming device and when rotated in one direction will feed a media in the media feed direction and when rotated in an opposite direction may act to block the feeding of media in the media feed direction or feed the media in a direction opposite to the media feed direction.

As used herein, the term "communication link" is used to generally refer to structure that facilitates electronic communication between multiple components, and may operate using wired or wireless technology. Communications among components may be done via a standard communication protocol, such as for example, universal serial bus (USB), Ethernet or IEEE 802.xx.

A controller includes a processor unit and associated memory and may be formed as one or more Application Specific Integrated Circuits (ASICs). The associated memory may be, for example, random access memory (RAM), read only memory (ROM), and/or non-volatile RAM (NVRAM). Alternatively, the associated memory may be in the form of a separate electronic memory (e.g., RAM, ROM, and/or NVRAM), a hard drive, a CD or DVD drive, or any memory device convenient for use with the controller. The controller may be illustrated in the figures as a single entity but it is understood that the controller may be implemented as any number of controllers, microcontrollers and/or processors.

Reference will now be made in detail to the example embodiments, as illustrated in the accompanying drawings. Whenever possible, the same reference numerals will be used throughout the drawings to refer to the same or like parts. Furthermore, and as described in subsequent paragraphs, the specific configurations illustrated in the drawings are intended to exemplify embodiments of the disclosure and that other alternative configurations are possible.

In FIG. 1, there is shown a representative imaging device 10, such as a color electrophotographic printer or laser printer. The imaging device 10 includes a body 12 include a top 14 having a media output area 16 and a front 18. A control panel 20 on front 18 provides information to a user and allows a user to input instructions for the operation of the imaging device 10. Provided imaging device 10 is a media input system 40, an imaging area 50 in which black-only and color toned images are created, an intermediate transfer unit 100 having a rotating intermediate transfer member (ITM) belt used to transfer the toned images to a media sheet, a media transport assembly 200 used for moving a media sheet through imaging device during simplex and duplex printing operations, a fuser assembly 300 used to fuse toned images to the media sheet, and a controller 400 for controlling operation of the imaging device based on user input and programming stored within imaging device 10.

Media input system 40 is provided in a lower region of imaging device 10 and includes a media input source such as a removable media input tray 42 sized to contain a media stack MS having media sheets M to be printed. Imaging device 10 may include more than one media input tray 42. It is understood that media sheets may be fed into media transport assembly 200 from other sources such a manual media tray or from additional media input tray assemblies coupled to imaging device 10. As shown, a pick mechanism 44 having a motor 45 and pick roll 46 is provided above the media stack MS. When motor 45 is driven, pick mechanism 44 using pick roll 46 feeds a top-most media sheet from the media stack MS into media transport assembly 200.

Positioned in an upper region of imaging device 10 is imaging area 50 that includes a laser scan unit 52 and one or more imaging units, generally indicated at 60. Four imaging units 60Y, 60C, 60M and 60K (collectively 60Y-60K) are shown and are used for providing yellow, cyan, magenta, and black toned images to intermediate transfer unit 100. Imaging units 60Y-60K are aligned transversely relative to the direction of rotation of the ITM belt 102 with the yellow imaging unit 60Y being the most upstream, followed by imaging units 60C, 60M, and last, imaging unit 60K being the most downstream along ITM belt 102. Imaging units 60Y-60K include toner reservoirs 61Y, 61C, 61M, 61K, collectively 61Y-61K, having cyan, yellow, magenta, and black toners, respectively. Also provided in toner reservoirs 61Y-61K are toner agitators 67Y, 67C, 67M, 67K, respectively, that are rotated to ensure that the toner particles will flow freely.

Imaging units 60Y-60K include charge rolls 62Y, 62C, 62M, 62K, collectively 62Y-62K, developer rolls 63Y, 63C, 63M, 63K, collectively 63Y-63K, and rotating photoconductive (PC) drums 64Y, 64C, 64M, 64K, collectively 64Y-64K. PC drums 64Y, 64C and 64M are collectively referred to as color PC drums and PC drum 64K is referred to as a black PC drum. Charge rolls 62Y-62K are aligned with and in contact with PC drums 64Y-64K, respectively. Charge rolls 62Y-62K connect to a voltage supply 65 and charge their respective PC drum to a specified voltage, such as −900 volts, for example. Developer rolls 63Y-63K are connected to a voltage supply 66 and are charged to a specified voltage, such as −600 volts for example, and deliver charged toner particles from toner reservoirs 61Y-61K to the outer surfaces of PC drums 64Y-64K, respectively. As explained later, toned images, represented by black blocks 70Y, 70C, 70M, 70K, collectively 70Y-70K, are created on PC drums 64Y-64K by these charged toner particles.

PC drums 64Y-64K are rotated by drum motors 68Y, 68C, 68M, 68K, collectively 68Y-68K. Drum motors 68Y, 68C, 68M may be collectively referred to as color drum motors 68Y-68K while drum motor 68K may be referred to as a black drum motor 68K. While separate motors are shown for color PC drums 64Y-64M, as is known in the art a single color motor and appropriate gear train may be used. Also as is known in the art, charge rolls 62K-62Y, developer rolls 63Y-63K, and toner agitators 67Y-67K, may be coupled through respective gearing to drum motors 68Y-68K in order to be rotated.

In an example embodiment, the ITU 100 comprises an ITM belt 102 formed as an endless loop trained about a plurality of support rolls 103-105 positioned in a triangular arrangement. A motor 106 is used to drive one of the support rolls 103-105, roll 103 as shown, to rotate ITM belt 102 in a counter clockwise direction as shown in FIG. 1.

A plurality of electrically charged transfer rolls are provided in the interior of the loop formed by ITM belt 102. A transfer roll is provided for each PC drum. Transfer rolls 110Y, 110C, 110M, 110K, collectively 110Y-110K, are aligned with PC drums 64Y-64K, respectively. Transfer rolls 110Y-110K are connected to power supply 111 that applies a voltage to each transfer roll that is opposite (e.g. more positive) to the charge on the toned images 70Y-70K present on respective PC drums 64Y-64K. Transfer rolls 110Y-110K are aligned with PC drums 64Y-64K, respectively, and form first transfer nips 112Y, 112C, 112M, 112K, respectively. Transfer rolls 110Y, 110C, 110M are collectively referred to as the color transfer rolls. Transfer roll 110K is also referred to as the black transfer roll. Similarly first transfer nips 112Y,112C, 112M are referred to as the color transfer nips and first transfer nip 112K is also referred to as the black transfer nip. Transfer rolls 110Y-110K are rotated by ITM belt 102.

Figure 2B:
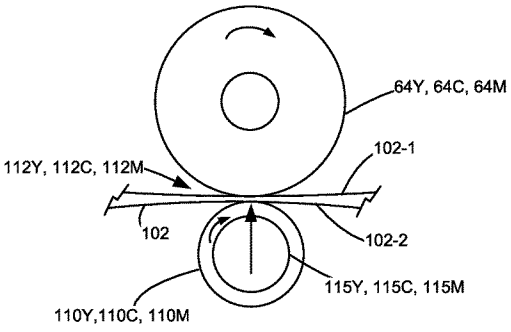
FIGS. 2A-2B schematically illustrate the disengaged and engaged position of the color transfer rolls for the imaging device of FIG. 1.
Figure 2A:
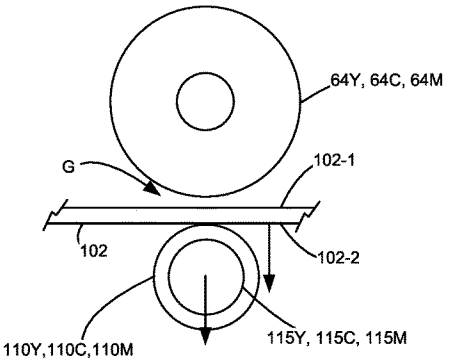

Color transfer rolls 110Y-110M are coupled to a retraction mechanism 113 which is used to move them between a disengaged position and an engaged position with respect to their respective color PC drum. The disengaged position of the color transfer rolls 110Y-110M is shown in FIG. 2A. A gap G is created between ITM belt 102 and each of the color PC drums as the color transfer rolls 110Y-110M are disengaged and retracted or moved away from their respective color PC drum. The ITM belt 102 follows the movement of the color transfer rolls 110Y-110M as they move away from the color PC drums 64Y-64M. In the engaged position, shown in FIG. 2B, the color transfer rolls 110Y-110M are moved by retraction mechanism 113 back toward their respective color PC drums. ITM belt 102 is pressed or pinched by the color transfer rolls 110Y-110M against their respective color PC drum, as indicated by the exaggerated bending of the outer and inner surfaces 102-1, 102-2 of ITM belt 102. First transfer nips 112Y, 112C, 112M are reformed. First transfer nips 112Y, 112C, 112M are also referred to the color transfer nips while first transfer nip 112K is referred to as the black transfer nip. Black transfer roll 110K is not coupled to retraction mechanism 113 and remains in an engaged position with respect to the black PC drum 64K and ITM belt 102 during all printing operations. This is done because black toner will be used in almost every image that will be printed. While a single retraction mechanism is shown, it will be understood an individual retraction mechanism may be provided for each of the color transfer rolls 110Y-110M.

Media transport assembly 200 is provided adjacent to media input system 40, imaging area 50 and ITU 100, and includes a media transport path 210, a media redrive system 240, a diverter gate 250, a plurality of media feed roll pairs 260 spaced about transport path 210, and a feed roll drive motor 270. Media transport path 210 extends from media input tray 42 to media output area 16. Media transport path 210 has a simplex portion 220 with a generally S-shaped configuration indicated by the dashed line and a duplex portion 230 with a generally reversed C-shaped configuration, indicated by the dotted line. Simplex portion 220 has an entrance 222 adjacent media input tray 42, an exit 224 adjacent media output area 16 and courses past ITU 100, through fuser assembly 300 to media redrive system 240. Duplex portion 230 has an entrance 232 and an exit 234 adjacent to exit 224 and entrance 222, respectively, of simplex portion 220. Media diverter gate is positioned at the exit 224 of simplex portion 220 and the entrance 232 of duplex portion 230. As is known, media position sensors S are provided at multiple locations of media transport path 210 to detect the leading and trailing edges of a media sheet as it passes along long media transport path 210 such as when exiting media input tray 42 entering and exiting simplex portion 220. Feed roll drive motor 270 is coupled to and drives the plurality of media feed roll pairs 260.

Media redrive system 240 is used to either feed a printed media sheet out into media storage area 16 or back in duplex portion 230 to be returned into simplex portion 220 to receive an image on its the reverse side. Media redrive system 240 may be a two roll or a three roll system. Media redrive system 240 as shown has two exit rolls 242, 244 with exit roll 242 having a drive motor 243. A three roll media redrive system 240A system is shown in the inset having three rolls 242A, 244A, 246A forming two feed nips where the two outboard rolls 242A, 244A each have a drive motor M. Operation of either a two or three roll media redrive system during simplex and duplex printing operations is well known in the art. Media redrive system 240 may also be termed a peek-a-boo duplexer. As is known three roll media redrive system 240A can process two media sheets by simultaneously feeding one media sheet out into media storage area 16 while feeding a second media back into duplex portion 230. Diverter gate 250 on one position allows a media to enter media redrive system 240 from simplex path 220. In a second position, diverter gate 250 allows a media sheet held in media redrive system 240 to be directed into entrance 232 of duplex portion 230.

Fuser assembly 300 is provided upstream of ITU 100 on simplex portion 220 near diverter gate 250 for fusing the transferred toner image 71 onto a surface of the media sheet M. Fuser assembly 300 may be a belt fuser or a hot roll fuser as is known in the art.

During a printing operation, controller 400 receives a print job containing print data representing one or more black images and/or one are more color images. Using stored programs, controller 400 formats the print data into one of the four colors and rasterizes it into one of four color data streams that are sent to the laser scan unit 52 which produces four laser beams, 56Y, 56C, 56M, 56K, collectively 56Y-56K, one for each color. It will be understood that not all colors will be present in a given image of a print job. Laser beams 56Y-56K contact the respective surfaces of the electrically charged rotating PC drums 64Y-64K discharging those areas contacted to form latent images, writing one laser scan line at a time. In one embodiment, areas on the PC drums 64Y-64K illuminated by the laser beams 56Y-56K are discharged to approximately −300 volts. Because developer rolls 63Y-63K are biased to about −600 volts the negatively charged toner particles provided by the developer rolls 63Y-63K are attracted to the more positively charged latent image areas on their respective PC drums 64K-64Y forming toned images in each of the colors Y, C, M, B. The process of writing scan lines, toning them, forming toned black and color images and transferring them to the rotating ITM belt 102 of ITU 100 is done continuously until the images have been completed and subsequently transferred to a media sheet in the transport path 210.

During image forming operations, the charge on each of the transfer rolls 110Y-110K causes the toned images 70Y-70K on the respective PC drums 64Y-64K to transfer to the outer surface 102-1 of ITM belt 102 as it passes through the first transfer nips 112Y-112K. For mono-color images, a toned image is applied from a single imaging unit 60, such as black imaging unit 60K or cyan imaging unit 60C for example. However, the majority of mono-color images are black. For color images, toned images are applied from two or more imaging units 60 such as imaging units 60Y, 60M and 60K. The transferred toner image 71 may be formed of a single toner. When only black toner is used, toner image 71 may be referred to as black toned image or black only toned image or as a mono-toned image when only one of the colored toners other than black toner is used. The toner image 71 may also be a combination of two or more of the toners laid on top of another and be referred to as a color toned image. For example, toned image 70C may be placed, in whole or in part, on top of toned image 70Y. Toned image 70M may be placed, in whole or in part on top of the combined toned images 70Y, 70M or on just toned image 70Y, and similarly for the black toned image 70K and any one or all. Once past imaging unit 60K, that portion of the toned image is complete and ready to be transferred onto the media sheet.

The transferred toned image, as indicated at 71, is carried by ITM belt 102 to an image transfer nip 114 formed between support roll 105 and an electrically charged image transfer roll 120. Image transfer roll 120 is connected to power supply 121. Image transfer roll 120 is charged to a voltage that is more positive than that of the transferred toned image 71. As a media sheet M passes through image transfer nip 114, the toned image 71 is transferred to a first surface of media sheet M. Media sheet M is then conveyed along simplex portion 220 to fuser assembly 300 where the toned image 71 is fused onto media sheet M. Next media sheet M is feed to redrive system 240 where it is either output to media output area 16 or feed past diverter gate 250 into duplex portion 230 to be returned to image transfer nip 114 to receive a new toned image on its reverse or second surface.

In another embodiment, the media sheet to be printed is directed onto the outer surface 102-1 of ITM belt 102 and through first transfer nips 112Y-112K to directly receive the transferred black and color toned images. The media sheet is then passed through fuser assembly 300 rather than going through image transfer area 114.

Controller 400 and associated memory 402 containing programming 404 controls the operation of the imaging device 10 including image formation, PC drum charging, color transfer roll engagement/disengagement as well as the present methods set forth in this disclosure. Power supplies 65, 66, 111, 121, motors 45, 68Y, 68C, 68M, 68K, 106, 243, 270, retraction mechanism 113, media redrive system 240, diverter gate 250, fuser assembly 300, and media position sensors S are all in operative communication with controller 400 via communication links. These communication links are not shown for purposes of clarity as the structure and use of such communication links are well known in the art.

Figure 3:
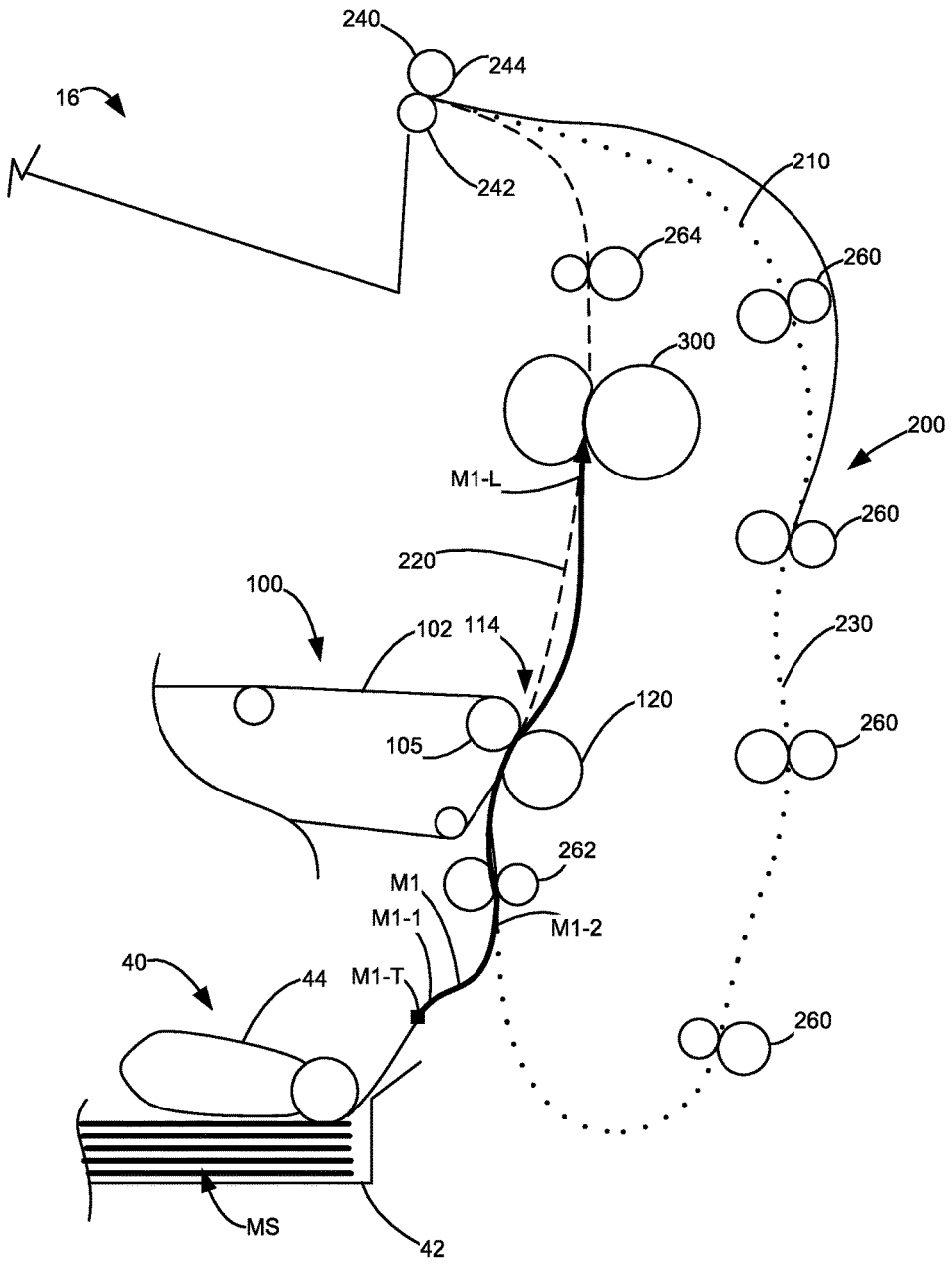
FIG. 3 shows a schematic view of a media transport path of the imaging device of FIG. 1 according to an example embodiment, showing a simplex printing operation.
Figure 4:
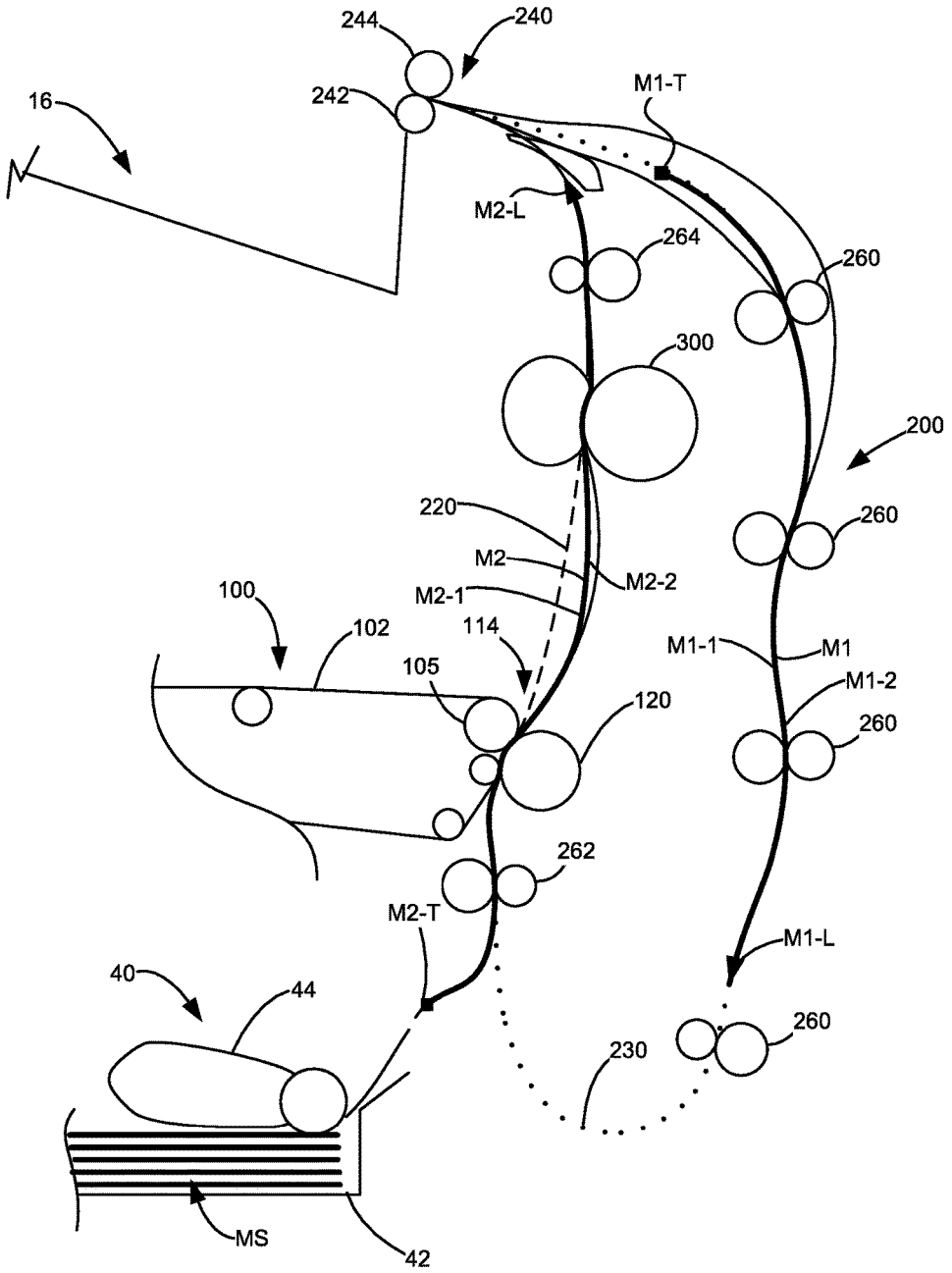
FIGS. 4-5 show the media transport path of FIG. 3 and a duplex printing operation where FIG. 4 show a first media sheet having a first image on a first side retracted towards a duplex media path and a second media sheet receiving a second image on a first side as it moves through a simplex media path and FIG. 5 shows the first media sheet reentering the simplex media path from duplex media path to receive a third image on the reverse side while and the second media sheet moved into the duplex media path.
Figure 5:
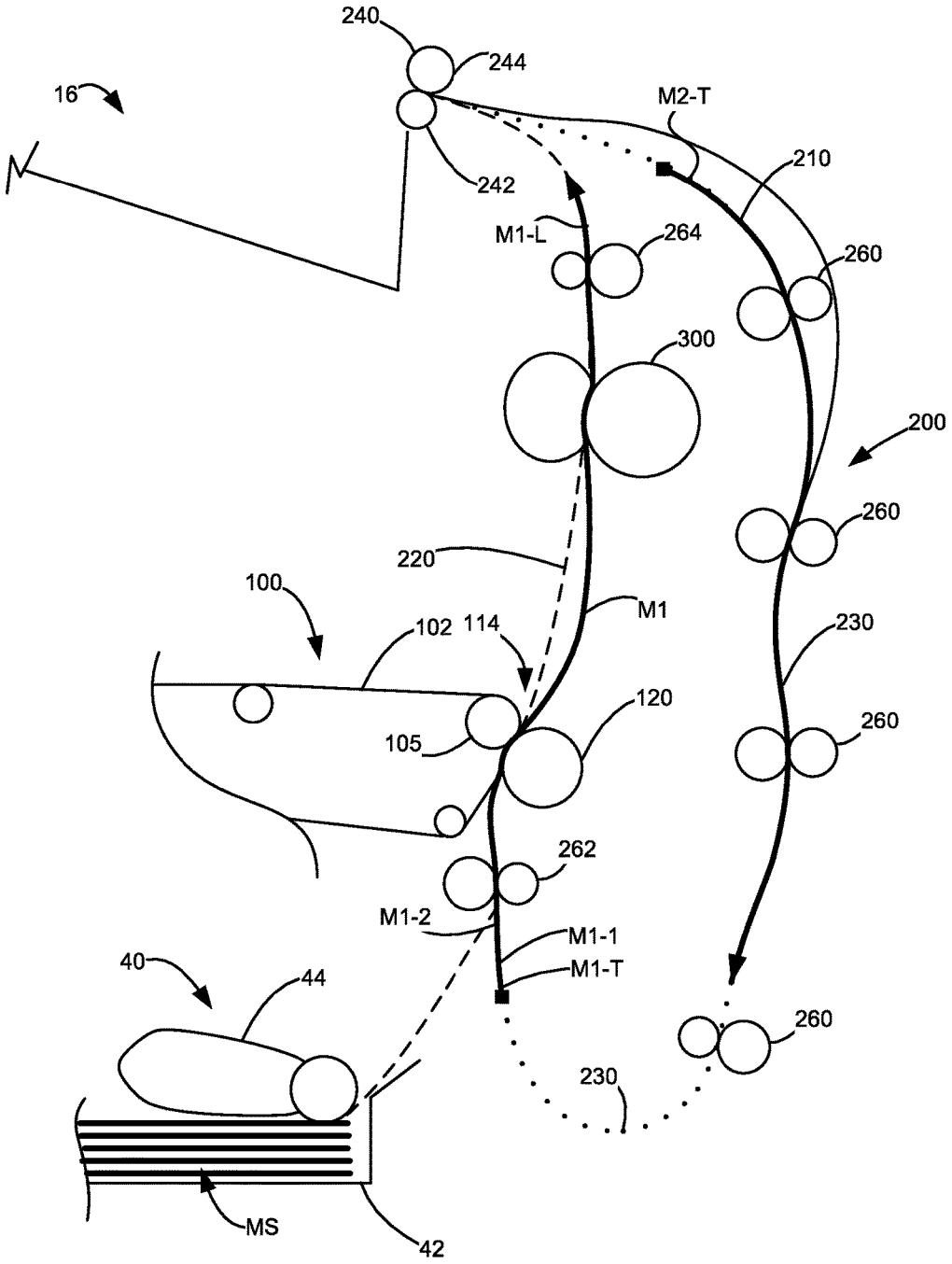

FIGS. 3-5 shows schematic view of media transport system 200 including media transport path 210 and with simplex and duplex portions 220, 230 and the movement of media sheets during simplex and duplex printing operations. In these figures the media sheets are shown being fed from the media stack MS in media input tray 42, however it is understood that media sheets may be fed into media transport path from other media input sources such a manual media tray or from additional media input tray assemblies coupled to imaging device 10.

In FIG. 3, media sheet M1 has first and second sides M1-1, M1-2, leading and trailing edges M1-L, M1-T, respectively. Sheet M1 has travelled from the media input tray 42 through media feed roll pair 262 where any skew in the leading edge M1-L of media sheet M1 is removed, past image transfer area 114 where color or black toned images are transferred to first surface M1-1. Leading edge M1-L has reached fuser assembly 300. As media sheet M1 passes through fuser assembly 300, color and/or black toned images are fused to the first surface M1-1. At media feed roll pair 264 downstream of fuser assembly 300, media sheet M1 is decurled and driven towards media redrive system 240.

For the two roll media redrive system 240, rolls 242, 244 may be rotated in either direction. When driven in a first direction, media sheet M1 is fed from the simplex portion 220 toward media output area 16. For duplex printing using a peek-a-boo system, as the trailing edge M1-T of media sheet M1 nears exit rolls 242, 244, their rotational direction is reversed moving media sheet M1 into duplex portion 230. When duplexing occurs, media sheet M1 is returned to image transfer area 114 where the second side M1-2 of media sheet M1 receives the new toned image. The new toned image is fused onto second side M1-2 and media sheet M is fed by media redrive system 240 into the media output area 16.

In one example embodiment, each of the following mechanisms is driven by an independent motor: pick mechanism 44, media feed roll pair 262, ITU 100, each of the PC drums 68Y-68K and media redrive system 240. Each of the media feed rolls 260 may share a common motor, and fuser assembly 300 and media feed roll pair 264 may share a common motor. The above configuration allows the highest duplex throughput for systems with a two roll media redrive system that cannot handle two media sheets at the same time.

FIGS. 4-5 illustrate a duplexing operation having two media sheets in the media transport path 210. With reference to FIG. 4, first media sheet M1 has been fed from media redrive system 240 shown in the duplex portion 230 with its first side printed M1-1. On entering the duplex portion 230, the leading and trailing edges of media sheet M1 are reversed with the former trailing edge becoming leading edge M1-L and forming leading edge becoming trailing edge M1-T. A second media sheet M2, having first and second sides M2-1, M2-2, and leading and trailing edges M2-L, M2-T, had been fed from media input tray 42 through image transfer area 114, where a second image has been transferred onto first surface M2-1, and fuser assembly 300 towards media redrive system 240. When a first side of the second media sheet M2 has been printed and to be driven into redrive system 240 and out towards the media output area 16, a first inter-page gap between media sheets M1 and M2 must occur. The now trailing edge M1-T of the first media sheet M1 as it is fed into duplex portion 230 must clear media redrive system 240 and leave time for media redrive system 240 to change direction before the leading edge M2-L of the second media sheet M2 reaches media redrive system 240. As a result, a first inter-page gap in a duplex printing operation is much larger than an inter-page gap when first media sheet M1 has undergone only a simplex printing operation as first media sheet M1 would be continue to be fed in the same direction and directly out into media output area 16.

Referring to FIG. 5, the second media sheet 125 has been driven by media redrive system 240 into duplex portion 230

46 and first media sheet M1 has reentered simplex portion 220. Second side M1-2 of first media sheet M1 receives a third image as it passes image transfer area 114. Leading edge M1-L1 is shown ready to media redrive system 240. A second inter-page gap is defined between the trailing edge M2-T of the second media sheet M2 and the leading edge M1-L of the first media sheet M1, such that these edges are positioned about the same distance from media redrive system 240. The second inter-page gap is usually greater than the first inter-page gap, as the media feed roll pairs 260 in the duplex portion 230 do not run at a speed faster than the process speed while the first media sheet M1 is still transferring from the duplex portion 230 and into simplex portion 220. Further, the second inter-page gap cannot be extended to allow transitions between black-only and color printing as the media sheet being moved into duplex portion 230 will run into the other media sheet already in the duplex portion 230. As a result of this gap, the motor of media feed roll pairs 260 speeds up such that the trailing edge M2-T of second media sheet M2 clears media redrive system 240 as soon as trailing edge M1-T of the first media sheet M1 exits duplex portion 230. Because first media sheet M1 is transported into media output area 16 after printing second side M1-2, the feeding speed of second media sheet M2 through duplex portion 230 may be increased to reduce the inter-page gap between leading edge M2-L of second media sheet M2 and trailing edge M1-T of first media sheet M1.

In the present invention, there are three printing modes during a print operation—color, paused, and retracted. In the color mode, a color image is being transferred and each of the transfer rolls 110Y-110K are in their engaged position with PC drums 64Y-64K, respectively, and the drum motors 68Y-68K are engaged such that each of the PC drums 64Y-64K are rotated to transfer color toned images and black toned image onto ITM belt 102. In the pause mode, rotation of the color PC drums 64Y-64M is stopped by turning off drum motors 68Y-68M while color transfer rolls 110Y-110M remain are in their engaged positions with their respective color PC drum, causing a static charge to build up on the color PC drums. In the retracted mode, rotation of the color PC drums 64Y-64M is stopped by turning off drum motors 68Y-68M and the color transfer rolls are moved to their disengaged position that is retracted from their respective color PC drum allowing ITM belt 102 to separate from the color PC drums. When the print operation is in the retracted mode, no static charge is built up on the color PC drums.

FIGS. 6-10 are flowcharts of a printing method M10, and printing mode routines—a color mode routine R10, a pause mode routine R20, a retract mode routine R30, and a shutdown mode routine R40—run during a print job having transitions between black-only and color printing operations. The terms "image" and "page" in the description of these methods and routines is used interchangeably.

Figure 6:
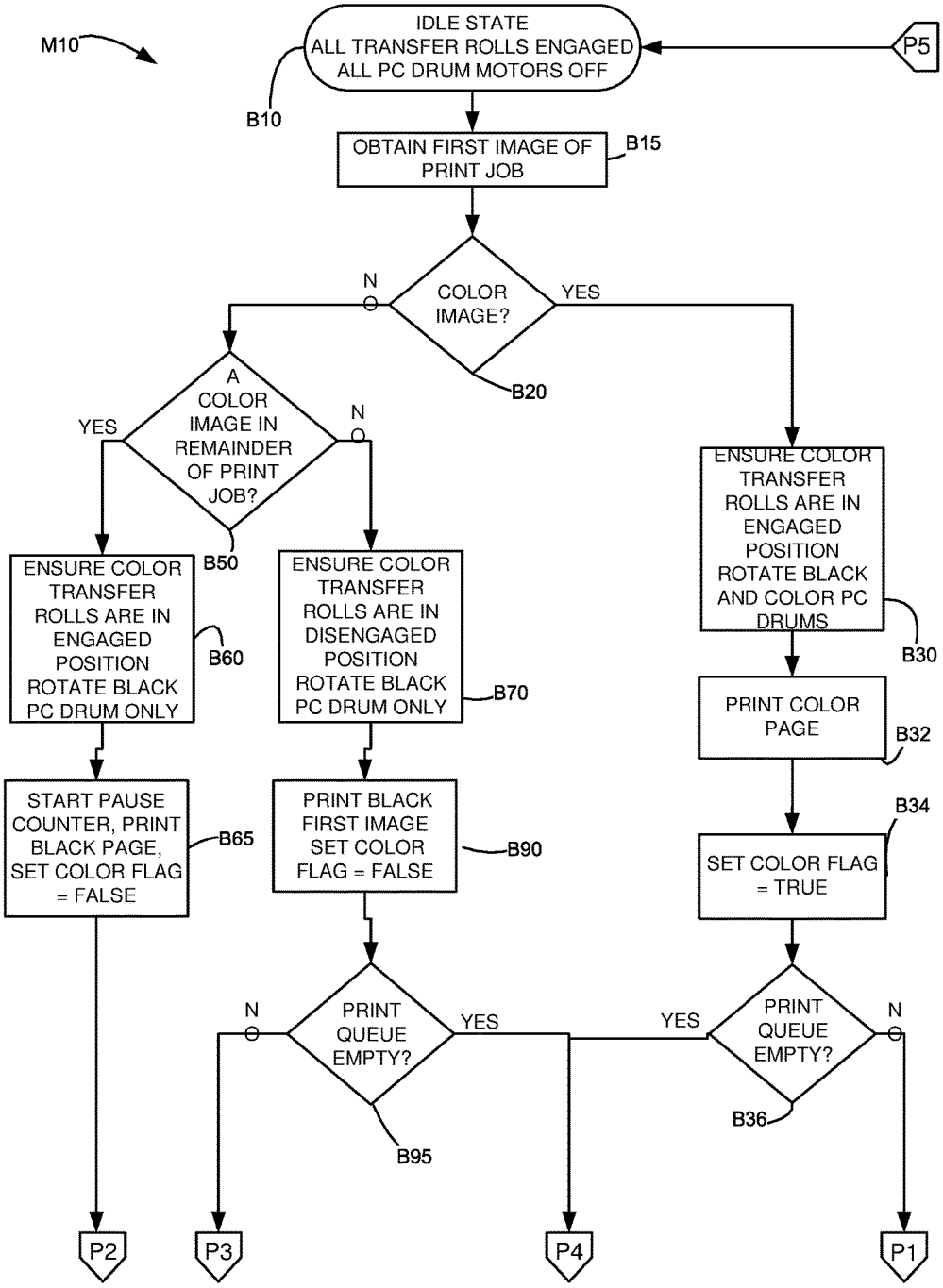
FIG. 6 is a flowchart showing a method of controlling toned image transfers during transitions between black-only and color printing where a print mode and operation of the imaging units is selected based on the color type of a first image of a print job.
Figure 10:
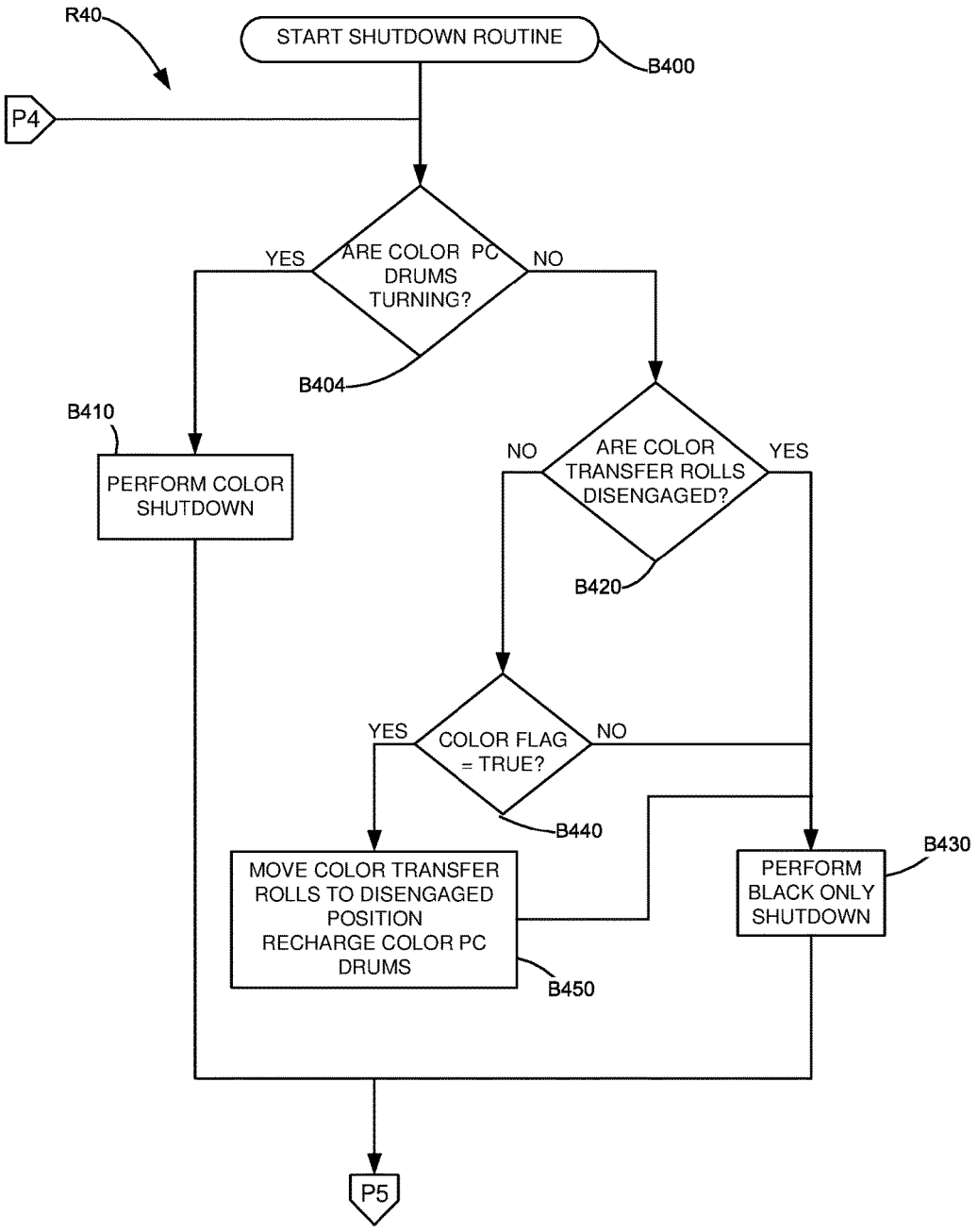
FIG. 10 is a flowchart of one example method for processing a shutdown operation.

With reference to FIG. 6, the method M10 starts at block B10 with the imaging device 10 being in an idle state prior to the beginning a print job. When in the idle state, all PC color drums 64Y-64M are engaged with their associated color transfer rolls 110Y-110M and all drum motors 64Y-64K are off. As previously stated the black transfer roll and black PC drum always remain engaged. Controller 400 receives a print job containing pages to be printed with each page containing either a black-only image or a color image. At block B15, the first image in the print job received by controller 400. At block B20, controller 400 performs a color test which determines whether or not the first image is a color image or a black-only image. When the first image is determined to be a color image, at block B30, method M10 ensures that the color transfer rolls 110Y-110M are in their engaged position and that the black and color PC drums are rotating. Next, at block B32, method M10 prints a color page. At block B34, a color flag is set to indicate that a color page has been printed during a print job. The color flag is set to TRUE. At block B36, controller 400 determines whether or not the color page printed was the last page image in the print job or in other words is the print queue empty. When it is determined that the color page printed was the last page in the print job, the shutdown routine R40, as will be explained in reference to FIG. 10, is entered via path P4. Otherwise, when it is determined that the printed color page is not the last page, method M10 proceeds to block B104 in the color mode routine R10 via path P1.

Referring back to block B20, when the first image is determined to be a black-only image, method M10 proceeds to block B50 to determine whether or not the remainder of the print job includes a color image. When the remainder of the print job is determined to have a color image, method M10 proceeds to block B60 enters the pause state to ensure that the color transfer rolls 110Y-110M are in their engaged positions and that only the black PC drum 64K is turning. At block B65, controller 400 starts a pause counter containing a value representative of the charge buildup on the color PC drums. The pause counter may either be the number of pages printed while in the pause mode routine R20 or the amount of time the print operation has spent in the pause mode routine R20. In one example embodiment, the pause counter is counting the number of pages printed while in the pause mode routine R20. After starting the pause counter, the first image which is a black-only image is printed and the color flag is cleared and set to FALSE. In an alternate embodiment the color flag is cleared and set to TRUE, indicating that a color page will be printed. The method M10 returns to block 204 of pause mode routine R20 via path P2 as will be discussed in greater detail below. The next image may be black or color—the color image may be after several black only images in the print queue or print job. When a color image is reached, the color transfer rolls 110k-110Y are checked to ensure that they are in their engage position and that all of the PC drums 64Y-64K are rotating . When the color flag is set to TRUE, then it is always set in the pause mode routine R20, and the flag test determination at block B440 in the shutdown routine R40 shown in FIG. 10 always is YES, so the color PC drums are always recharged when paused. When the color flag is set to FALSE, then the flag test at block B440 allows a black only shutdown without recharging the color drums from pause mode. When the print queue is short, then the time running in pause mode routine R20 is short and the small amount of charge buildup does not have to be removed. This would occur if an error occurred before the first color page was printed.

Referring back to block B50, when the print job is determined to include only black-only images, at block B70, method M10 enters the retract mode routine R30, as described with reference to FIG. 9. At block B90, the black first image is printed and the color flag is cleared and set to FALSE. At block B95, a determination is made whether or not the print queue is empty. When it is determined that the print queue is empty and the print job is done, method M10 transitions to shutdown routine R40, as described in reference to FIG. 10, via path P4. Otherwise, when determined that the print job still contains images to be printed, the print operation will continue in the retract mode routine R30 at block B304 via path P3.

Figure 7:
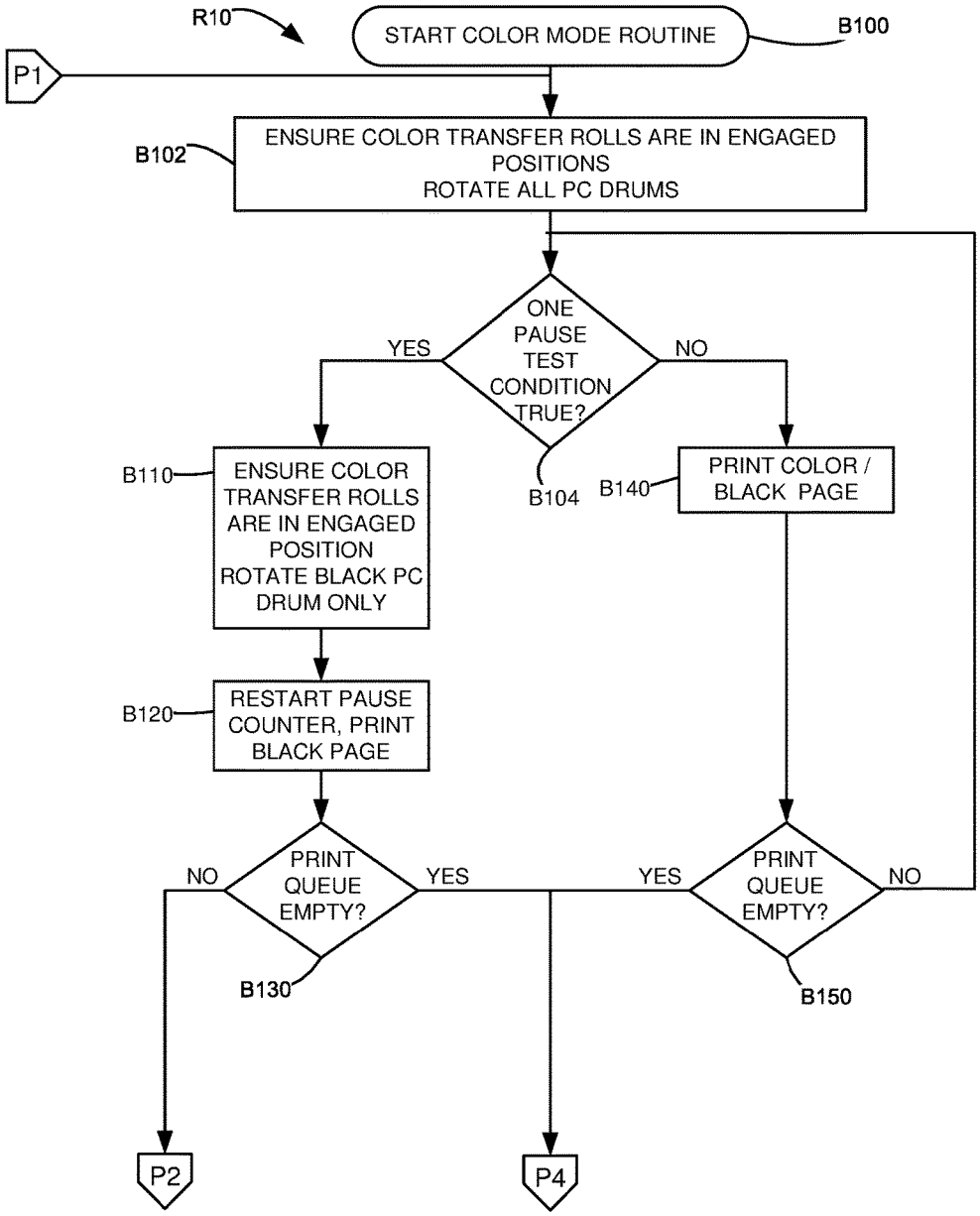
FIG. 7 is a flowchart of one example method for transitioning between color and black-only printing when a print operation is in a color mode.

FIG. 7 illustrates the color mode routine R10 starting at block B100. Next at block B102, color transfer rolls 110Y-110M are checked to ensure that they are in their respective engaged positions with color PC drums 64Y-64M, moved to their engaged positions when they are not, and rotating PC drums 64Y-64K by starting their respective PC drum motors 64Y-64K. At block B104, a pause test determination is made to determine that at least of the following conditions is true—whether or not the next two images in the print job are black-only images and whether or not the print job contains only one remaining image and that the one remaining image is a black-only image. On determining that at least one of the conditions is true, at block B110, the color transfer rolls 110Y-110M are checked to ensure that they are in their engaged positons and the black PC drum 64K is checked to ensure that it is rotating. To transition to the pause mode routine R20, the rotation of the color PC drums color is stopped. For simplex transitions, the color drum motors 68Y-68M are unable to stop and restart their respective color PC drums 64Y-64M within a single page, therefore a minimum of two sequential black-only pages is required to transition from the color mode to the pause mode. At block B120, the pause counter is reset and restarted and the next black-only image is printed. The color flag was set as shown in routines R20, R30 shown in FIGS. 8 and 9, respectively, when entering color mode routine R10. At block B130, a determination is made whether or not the image just printed was the last image in the print job and the print queue is empty. When it is determined that the image printed was the last image, color routine R10 transitions to shutdown routine R40 via path P4. Otherwise, when it is determined that the print job still contains images to be printed, the color routine R10 transitions to pause mode routine R20 at block B204.

Referring back to block B104, when determined that neither of the two aforementioned conditions are met, at block B140, the next black-only or color image in the print job is printed. At block B150, a determination is made whether or not the image just printed was the last image in the print job and the print queue is empty. When it is determined that the image printed was the last image, color routine R10 transitions to shutdown routine R40 via path P4. Otherwise, when it is determined that the print job still contains images to be printed, the color routine R10 returns to block B104.

Figure 8:
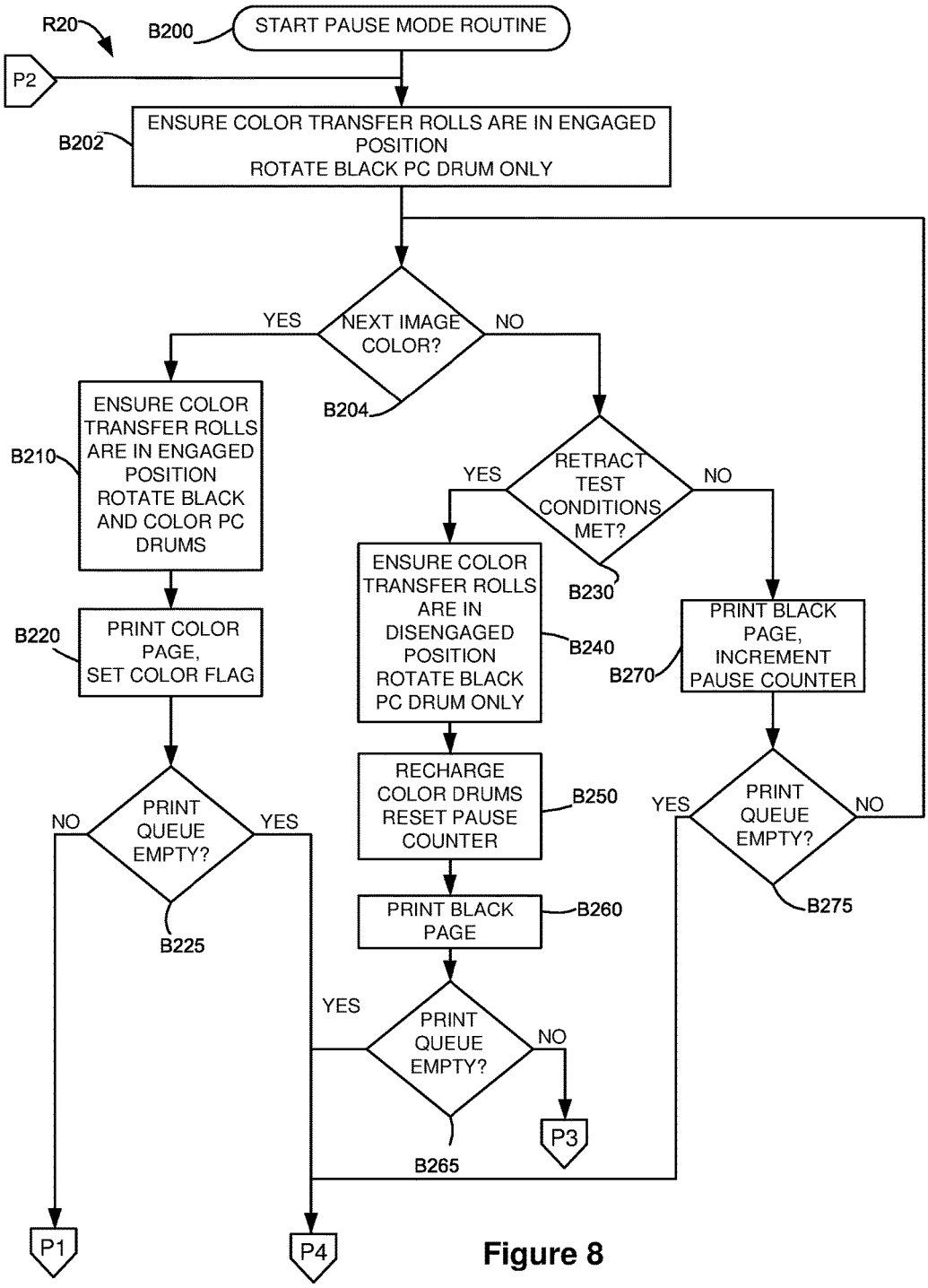
FIG. 8 is a flowchart of one example method for transitioning between color and black-only printing when a print operation is in a pause mode.

FIG. 8 shows the pause mode routine R20 starting at block B200. Next at block B202, color transfer rolls 110Y-110M are checked to ensure that they are in their engaged positions, moved to their engaged position when they are not, however here only the black PC drum motor 68K is started rotating the black PC drum 64K.

At block B204, a determination is made whether or not the next image in the print job is a color image. When it is determined that the next image is a color image, at block B210, color transfer rolls are checked to see that they are in the engaged positions and all of the PC drums 64Y-64K are rotating. The rotation of color PC drums 64Y-64M is restarted. At block B220, the color image is printed and the color flag is set to TRUE. At block B225, determination is made whether or not the print queue is empty. When it is determined that the print queue empty, pause mode routine R20 transitions to shutdown mode routine via path P4. Otherwise, when determined that the print job still contains images to be printed, the pause mode routine R20 will transition to the color mode routine R10 at block B104 via path Pl.

Referring back to block B204, when it is determined that the next image is not a color image, performs a retract test at block B230, where a determination is made whether or not the following two conditions are true: are the remaining images in the print job black-only images and has the pause counter reached a maximum predetermined value. When it is determined that both conditions are true, at block B240, the color transfer rolls 110Y-110K are checked to see that they are in their disengaged position and that only the black pc drum 64K is rotating. The pause mode routine may be used for multiple pages before a transition to the retract mode routine R30 is required as determined at block B230. In an example embodiment, it takes more than a minute of continuous printing to generate a sufficient charge on the color PC drums to cause a print defect at the normal process speed. Even after a minute of continuous black-only printing, the transition from the pause mode routine R20 to the retract mode routine R30 does not occur when a color image is still present in the print queue or print job because the charge buildup on the color PC drums will be removed when a color image is printed and only when there is a long delay (a delay in excess of the predetermined value of the pause counter) will the charge buildup cause a print defect.

Next, at block B250, color PC drums 64Y-64M are recharged and the pause counter is reset. Due to the charge buildup on each surface of the color PC drums 64Y-64M there is a need to recharge them. Respective color drum motors 68Y-68M are restarted and charge voltages from respective charge rolls 62Y-62M are applied to color PC drums 64Y-64M. Color PC drums 64Y-64M are then rotated from a position at their respective first transfer nip 112Y-112M to a position past their respective charge rolls 62Y-62M, removing the charge buildup. At block B260, a black-only image page is printed. At block B265, a determination is made whether or not the image just printed was the last image in the print job and the print queue is empty. When it is determined that the image printed was the last image, pause mode routine R20 transitions to shutdown routine R40 via path P4. Otherwise, when it is determined that the print job still contains images to be printed, the pause mode routine R20 transitions to retract mode routine R30 at block B304 via path P3.

Figure 9:
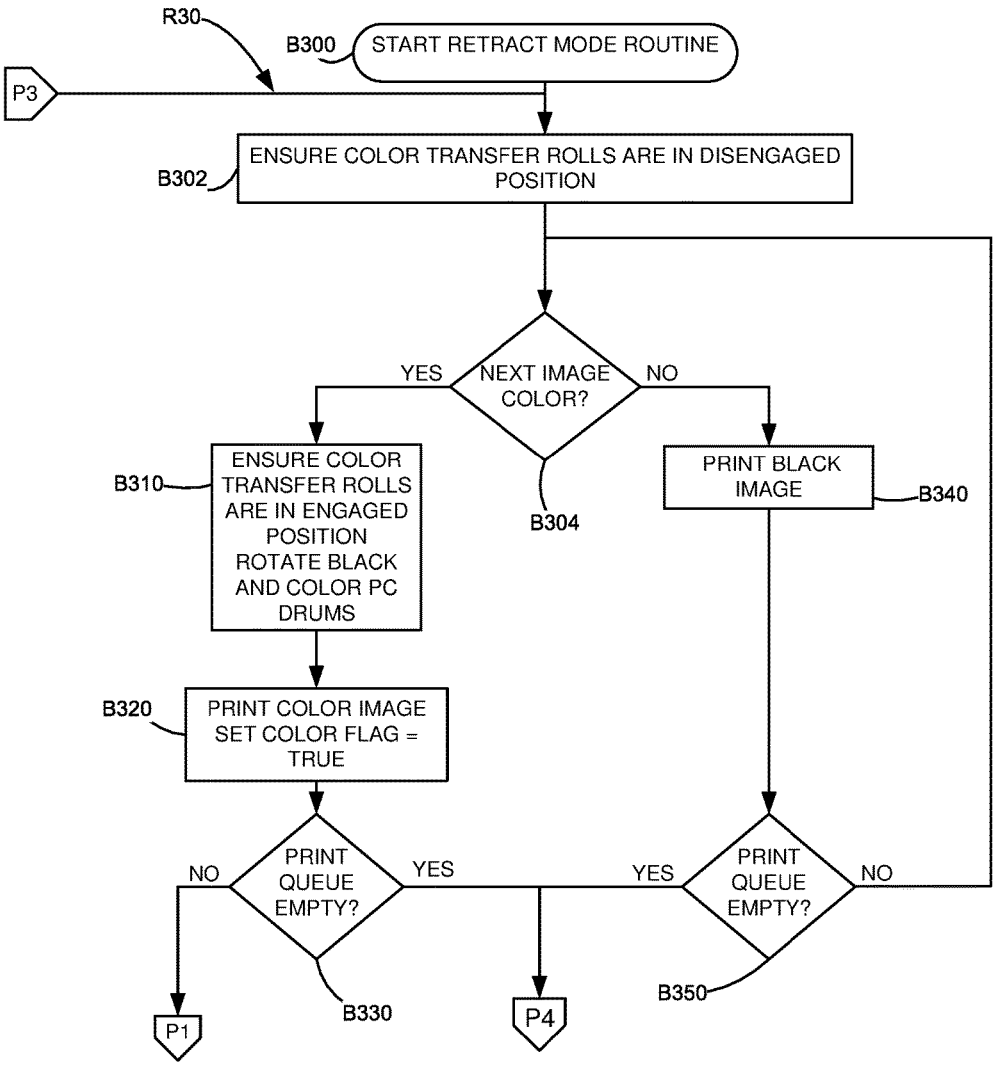
FIG. 9 is a flowchart of one example method for transitioning between color and black-only printing when a print operation is in a retract mode.

FIG. 9 shows the retract mode routine R30 starting at block B300. Next at block B302, color transfer rolls are checked to ensure that they are in their disengaged position with their respective colors PC drums, and moved to their disengaged position when they are not.

At block B304, a determination is made whether or not the next image in the print job is a color image. When it is determined that the next image is a color image, retract mode routine R30, at block B310, the color transfer rolls 110Y-110M are checked to ensure that they are in their engaged positions and that the black and color PC drums 64K, 64Y-64M are rotating for transferring the color toned images onto ITM belt 102. At block B320, the color image is printed and the color flag is set to TRUE. Next, at block B330 determination is made whether the print queue is empty. When it is determined that the print queue is empty, retract routine R30 proceeds to shutdown routine R40, as discussed with reference to FIG. 10, via path P4. Otherwise, when it is determined that the print queue is not empty and still contains images to be printed, the routine R30 transitions to color mode routine R10 at block B104 via path P1.

Referring back to block B304, when the next image is determined to be a black-only image, at block B340, the black-only image is printed. At block B350, a determination is made whether or not the print queue is empty. When it is determined that the print queue, retract routine R30 proceeds to shutdown routine R40 via path P4. Otherwise, when it is determined that the print job still contains images to be printed, retract routine R30 returns to block B304.

With reference to FIG. 10, shutdown routine R40 begins at block B400. At block B404, a determination is made whether or not the color PC drums 64Y-64M are rotating. When it is determined that the color PC drums 64Y-64M are rotating, at block B410, a color shutdown occurs wherein the all drum motors 64Y-64K are stopped, stopping PC drums 64Y-64K. Shutdown routine R40 then transitions via path P5 to block B10 and method M10 returns to the idle state, previously described, to wait for the next print job.

When it is determined that color PC drums 64Y-64M are not rotating, at block B420 a determination is made whether or not the color transfer rolls 110Y-110M are in their disengaged position. When it is determined that the color transfer rolls 110Y-110M are in their disengaged position, at block B430, a black-only shutdown is performed wherein only black drum motor 68K is stopped, stopping rotation of black PC drum 64K. Shutdown routine R40 then transitions via path P5 to block B10 and method M10 returns to the idle state to wait for the next print job.

When it is determined that the color transfer rolls 110Y-110M are not in their disengaged position, shutdown routine R40 proceeds to block B440. At block B440, a determination is made whether or not the color flag is set to TRUE. When the color flag is determined to be set to TRUE, shutdown routine R40 proceeds to block B450, where the color transfer rolls are retracted into their respective disengaged positions and each of the color PC drums 64Y-64M are recharged, as discussed with reference to FIG. 9. Shutdown routine R40 then proceeds to block B430 to perform the black-only shutdown. Shutdown routine R40 then transitions via path P5 to block B10 and method M10 returns to the idle state to wait for the next print job.

There are a number of special cases when a shutdown is required. An example is when a paper jam occurs while in the pause mode, static charge may accumulate and be left on each of the color PC drums 64Y-64M until the paper jam is cleared. As a result, the shutdown routine R40 is performed following an occurrence of a paper jam to clear off the accumulated static charge, rather than just stopping black drum motor 68K. The shutdown routine R40 allows ITM belt 102 to stop immediately while the color PC drums 64Y-64M rotate, avoiding any impact on the paper jam recovery.

Another example is a more serious event, such as a motor failure, that requires the imaging device 10 to be powered off to recover or a service repair is needed. This also includes the case where the power button is pressed during printing turning imaging device 10 off. If any of the example events occur, the shutdown routine R40 is performed to clean off the color PC drums 64Y-64M instead of stopping ITM belt 102 immediately. Other cases include loss of power while in the pause mode routine R20 or a programming failure resulting in a shutdown where motor power is removed without programing/firmware control. In such cases, the static charge buildup could be left on the color PC drums 64Y-64M indefinitely. The charge buildup determines the maximum delay or pause value in the pause counter while in the pause mode routine R20. A short delay value may be selected to avoid any print defect or a longer delay value may be selected to avoid permanent damage to the color PC drums 64Y-64C. If the print defect is minor and disappears after a few minutes of printing, remaining in the pause mode routine R20 may be accepted in favor of higher throughput and reduced supply churn.

The foregoing description of several methods and example embodiments has been presented for purposes of illustration. It is not intended to be exhaustive or to limit the invention to the precise steps and/or forms disclosed, and obviously many modifications and variations are possible in light of the above teaching. It is intended that the scope of the invention be defined by the claims appended hereto.

What is claimed is:

1. A method of controlling printing a print job having two or more consecutive images using an imaging device, the imaging device having a media transport path extending from an input media source to a media output area for transporting a media sheet to printed, a rotating intermediate transfer member (ITM) belt forming an endless loop having an inner surface and an outer surface, a portion of the outer surface having a toned transferred image thereon positioned adjacent to an image transfer roll positioned along a media transport path for transferring the toned transferred image onto a surface of the media sheet to be printed, a plurality of color imaging units having a color photoconductive (PC) drum and an associated color charging roll in contact therewith, each color PC drum engageable with the ITM belt for depositing a color toned image when present to the outer surface of the ITM belt, a black imaging unit having a black PC drum and an associated black charging roll in contact therewith, the black PC drum engaged with the ITM belt for depositing a black toned image when present to the outer surface of the ITM belt, a black transfer roll being in an engaged position against the inner surface of the ITM belt and positioned to press the outer surface of the ITM belt against the outer surface of the black PC drum, a plurality of retractable color transfer rolls being disposed adjacent to the inner surface of the ITM belt, the plurality of color transfer rollers moveable between an engaged position and a disengaged position wherein when in the engaged position respective ones of the plurality of color transfer rolls press the outer surface of the ITM belt into contact with the outer surface of a respective one of the plurality of color PC drums and, when in the disengaged position, the outer surface of the ITM belt is separated from the outer surface of the respective color PC drum of the at least one color imaging unit, and a controller communicatively coupled to the plurality of color imaging units, the black imaging unit, the black transfer roll and the plurality of retractable color transfer rolls and configured to control the operation thereof and to perform the method, the method comprising:

identifying that a first image of a print job is a black-only image;

determining whether or not the print job includes at least one color image;

upon determining that the print job includes at least one color image:

rotating only the black photoconductive drum and transferring a black-only toned first image thereon onto the outer surface of the rotating ITM belt and subsequently onto a surface of the media sheet at the image transfer roll; and moving each respective color transfer roll into its respective engaged position with its respective color PC drum and pausing the rotation of the color PC drums; and upon determining that the print job does not include at least one color image:

moving each respective color transfer roll into its respective disengaged position; and rotating only the black photoconductive drum to sequentially transfer each remaining black-only toned image thereon onto the outer surface of the rotating ITM belt and subsequently onto a surface of a corresponding next sequential media sheet at the image transfer roll.

2. The method of claim 1, wherein upon determining that the print job includes at least one color image further determining whether a second image following the first image in the print job is a color image, and upon determining that the second image is a color image, moving each color transfer roll into its engaged position and rotating the black and color PC drums so that respective color and black toned images thereon forming the second color image are transferred to the ITM belt.

3. The method of claim 2, wherein when the second image printed is a last image in the print job, performing a color shutdown.

4. The method of claim 1, further comprising:

upon determining that the print job does not include at least one color image starting a pause counter for providing a value indicating the amount of time in which the plurality of color transfer rolls are in their respective engaged positions and its respective color PC drum is paused in its rotation determining whether or not one of the following is true: (1) the pause counter value has reached a predetermined value and (2) a second image of the print job is a color image;

upon determining that the pause counter value has reached the predetermined value:

rotating the black photoconductive drum to transfer the black toned subsequent to the outer surface of the ITM belt; and moving each respective color transfer roll into its respective disengaged position;

upon determining that the second image is a color image:

resetting the pause counter;

moving each color transfer roll into its engaged position and rotating the black and color PC drums so that respective color and black toned images thereon forming the third image are transferred to the ITM belt.

5. The method of claim 4, wherein the pause counter is a page counter and the value is a count of the pages printed.

6. The method of claim 4, wherein the pause counter is a timer.

7. The method of claim 4, wherein:

when the second image printed is a last image in the print job:

determining whether or not a color image has been printed;

upon determining that a color image has been printed, electrically recharging each color photoconductive drum, and upon determining that a color image has not been printed, performing a black-only shutdown.

8. The method of claim 4, wherein upon determining a reminder of the print job does not include at least one color image and that the value of pause counter has reached the predetermined value, rotating only the black photoconductive drum to transfer a black toned second image thereon onto the outer surface of the ITM and moving the plurality of color transfer rolls into their respective disengaged positions.

9. The method of claim 8, wherein:

when the second image is a last image in the print job, determining whether or not a color image has been printed;

upon determining that a color image has been printed: recharging each color photoconductive drum; and performing a black-only shutdown; and upon determining that a color image has not been printed, performing the black-only shutdown.

10. A method of controlling printing a print job having two or more consecutive images using an imaging device, the imaging device having a media transport path extending from an input media source to a media output area for transporting a media sheet to printed, a rotating intermediate transfer member (ITM) belt forming an endless loop having an inner surface and an outer surface, a portion of the outer surface having a toned transferred image thereon positioned adjacent to an image transfer roll positioned along a media transport path for transferring the toned transferred image onto a surface of the media sheet to be printed, a plurality of color imaging units having a color photoconductive (PC) drum and an associated color charging roll in contact therewith, each color PC drum engageable with the ITM belt for depositing a color toned image when present to the outer surface of the ITM belt, a black imaging unit having a black PC drum and an associated black charging roll in contact therewith, the black PC drum engaged with the ITM belt for depositing a black toned image when present to the outer surface of the ITM belt, a black transfer roll being in an engaged position against the inner surface of the ITM belt and positioned to press the outer surface of the ITM belt against the outer surface of the black PC drum, a plurality of retractable color transfer rolls being disposed adjacent to the inner surface of the ITM belt, the plurality of color transfer rollers moveable between an engaged position and a disengaged position wherein when in the engaged position respective ones of the plurality of color transfer rolls press the outer surface of the ITM belt into contact with the outer surface of a respective one of the plurality of color PC drums and, when in the disengaged position, the outer surface of the ITM belt is separated from the outer surface of the respective color PC drum of the at least one color imaging unit, and a controller communicatively coupled to the plurality of color imaging units, the black imaging unit, the black transfer roll and the plurality of retractable color transfer rolls and configured to control the operation thereof and to perform the method, the method comprising:

identifying that a first image of a print job is a black-only image;

rotating only the black photoconductive drum to transfer a black-only toned first image thereon onto the outer surface of the rotating ITM belt and subsequently onto a surface of the media sheet at the image transfer roll;

moving each respective color transfer roll into its respective engaged position with its respective color PC drum and pausing the rotation of the color PC drum;

starting a pause counter for providing a value indicating the amount of time in which the plurality of color transfer rolls are in the respective engaged positions and its respective color photoconductive drum is paused in its rotation;

determining whether or not one of the following is true: (1) the pause counter value has reached a predetermined value and (2) a second image in the print job is a color image;

upon determining that the pause counter value has reached the predetermined value:

rotating the black photoconductive drum to transfer a black toned second image to the outer surface of the ITM belt; and rotating only the black photoconductive drum to transfer a subsequent black-only toned image thereon onto the outer surface of the rotating ITM belt and subsequently onto a surface of a subsequent media sheet at the image transfer roll; and moving each respective color transfer roll into its respective disengaged position;

upon determining that the second image is a color image: resetting the pause counter;

moving each color transfer roll into its engaged position and rotating the black and color PC drums so that respective color and black toned images thereon forming the second image are transferred to the ITM belt subsequently onto a surface of a second media sheet at the image transfer roll.

11. The method of claim 10 further comprising:

determining whether or not the color second image is a last image in the print job;

upon determining that the color second image is a last image in the print job, performing a color shutdown and recharging each color PC drum;

moving each respective color transfer roll into its respective engaged position.

* * * * *